United States Patent [19]

Kawaguchi et al.

[11] 4,448,125

[45] May 15, 1984

[54] SHEET-FED ROTARY PRINTING MACHINE WITH A TURN-OVER MECHANISM

[75] Inventors: Shoichi Kawaguchi; Hiroyuki Sugiyama, both of Toride, Japan

[73] Assignee: Komori Printing Machinery Co., Ltd., Tokyo, Japan

[21] Appl. No.: 503,302

[22] Filed: Jun. 10, 1983

[30] Foreign Application Priority Data

Jun. 14, 1982 [JP] Japan ..... 57-101885

[51] Int. Cl.[3] ..... B41F 5/16

[52] U.S. Cl. ..... 101/185; 271/82; 271/277; 101/232

[58] Field of Search ..... 101/185, 184, 231, 140, 101/145, 230, 232, 183, 408–411; 271/82, 277

[56] References Cited

U.S. PATENT DOCUMENTS

| | | | |
|---|---|---|---|
| 2,757,610 | 8/1956 | Gegenheimer | 101/183 |
| 3,414,259 | 12/1968 | Koch et al. | 271/82 |
| 3,455,547 | 7/1969 | Rudolph | 271/82 |
| 3,534,683 | 10/1970 | Barthel | 101/410 X |
| 3,654,861 | 4/1972 | Rudolph et al. | 101/183 |
| 3,796,154 | 3/1974 | Weisgerber | 271/277 X |
| 3,992,993 | 11/1976 | Kuhn et al. | 101/409 |
| 4,018,161 | 4/1977 | Johne et al. | 271/82 X |
| 4,343,241 | 8/1982 | Rudolph | 101/410 X |
| 4,357,870 | 11/1982 | Rudolph | 101/409 X |

*Primary Examiner*—E. H. Eickholt

*Attorney, Agent, or Firm*—Charles E. Pfund

[57] ABSTRACT

A sheet-fed rotary printing machine with a turn-over mechanism includes a turn-over cylinder interposed between printing cylinders in a pair of printing units and having a pair of gripper shafts mounted on an outer circumferential surface of the turn-over cylinder in diametrically opposite relation. A plurality of turn-over gripper devices are mounted at intervals on each of the gripper shafts, each turn-over gripper device being composed of a fixed turn-over gripper and a loosely fitted gripper pad assembly. The turn-over cylinder also has a cam mechanism for turning over the turn-over gripper devices and another cam mechanism for opening and closing the turn-over gripper devices. A plurality of suction levers are mounted on a suction lever shaft extending parallel to the gripper shaft in alignment with the turn-over grippers, the suction levers being angularly movable by a cam mechanism for limiting angular movement of the gripper pad assemblies during single side printing operation, and for attracting the trailing edge of a sheet during double side printing operation. With this arrangement, the sheet can be turned over by the printing cylinders and the single turn-over cylinder therebetween, and the turn-over grippers can be turned over and opened and closed about the gripper shaft in both the single and double side printing modes. The printing machine thus constructed is simple in construction, can grip sheets with high accuracy, and operate at high speeds.

2 Claims, 13 Drawing Figures

SHEET-FED ROTARY PRINTING MACHINE WITH A TURN-OVER MECHANISM

BACKGROUND OF THE INVENTION

The present invention relates to a sheet-fed rotary printing machine with a turn-over mechanism for use in both single side printing and double side printing.

To meet various printing demands, there has been proposed and practiced a variety of sheet-fed rotary printing machines with turn-over mechanisms capable of selectively effecting single side printing and double side printing. The printing machines of this type have a printing cylinder for printing one side of a sheet gripped by grippers thereon and then winding the sheet therearound, a turn-over cylinder disposed in confronting relation to the printing cylinder for gripping the printed sheet with turn-over grippers thereon and then turning over the sheet, and a next printing cylinder for effecting printing the reverse side of the sheet transferred from the turn-over cylinder. For single side printing only, the turn-over grippers remain inoperative to prevent the sheet from being turned over on the turn-over cylinder, and the sheet is transferred to the next printing cylinder so that the same first side of the sheet will be printed. The principles of the turn-over mechanism remain the same for various printing machines previously proposed. However, known printing machines have differently arranged cylinders and different turn-over mechanism constructions.

Some printing machines have a single turn-over cylinder interposed between front and rear printing cylinders. However, it is general practice to use front and rear printing cylinders, a transfer cylinder having the same diameter as those of the printing cylinders, another transfer cylinder having the diameter twice those of the printing cylinders, and a turn-over cylinder of the same diameter as those of the printing cylinder. The latter type of printing machine requires more cylinders and hence is costly to install, and also needs a large space between printing units, resulting in an increased length of the printing machine. This printing machine is also disadvantageous in that the more the printing units, the larger the printing machine.

The other type of printing machine, with a single turn-over cylinder interposed between printing cylinders, is simpler in cylinder arrangement, but the construction of the turn-over mechanism is quite complex. U.S. Pat. Nos. 3,455,547 and 3,654,861 disclose such printing machines. In the disclosed printing machines, turn-over grippers are pivotably mounted on free ends of arm pivotably supported on the cylinder periphery and angularly movable by a cam link mechanism, the turn-over grippers being openable and closable by another cam link mechanism. For double side printing, the turn-over grippers are caused to revolve in response to angular movement of the arms while the grippers are being opened and closed, and the turn-over grippers are actuated by the cam link mechanism to cooperate with suction devices in gripping the trailing edge of the sheet and turning over the sheet. When single side printing is to be effected, the angular movement of the arms and the actuation of the suction devices are arrested, and the sheet is gripped successively by the grippers as they are opened and closed.

With the different cam link mechanisms provided respectively for opening and closing the turn-over grippers and for turning the arms, however, the disclosed turn-over mechanism is quite complicated in structure, hence costly, and is subjected to poor precision during operation. During double side printing, the many turn-over grippers that are heavy have to revolve around the arm shafts different from gripper shafts about which the grippers are opened and closed. Therefore, the turn-over grippers undergo a large moment of inertia, cannot grip sheet edges with precision, and present an obstacle to high-speed operation of the printing machine.

SUMMARY OF THE INVENTION

It is an object of the present invention to provide a sheet-fed rotary printing machine with a turn-over mechanism which is simple in construction, can grip sheet edges highly accurately, and is capable of high-speed operation.

According to the present invention, a sheet-fed rotary printing machine with a turn-over mechanism includes a turn-over cylinder interposed between printing cylinders in a pair of printing units and having a pair of gripper shafts mounted on an outer circumferential surface of the turn-over cylinder in diametrically opposite relation. A plurality of turn-over gripper devices are mounted at intervals on each of the gripper shafts, each turn-over gripper device being composed of a fixed turn-over gripper and a loosely fitted gripper pad assembly. The turn-over cylinder also has a cam mechanism for turning over the turn-over gripper devices and another cam mechanism for opening and closing the turn-over gripper devices. A plurality of suction levers are mounted on a suction lever shaft extending parallel to the gripper shaft in alignment with the turn-over grippers, the suction levers being angularly movable by a cam mechanism for limiting angular movement of the gripper pad assemblies during single side printing operation, and for attracting the trailing edge of a sheet during double side printing operation. With this arrangement, the sheet can be turned over by the printing cylinders and the single turn-over cylinder therebetween, and the turn-over grippers can be turned over and opened and closed about the gripper shaft in both the single and double side printing modes. The printing machine thus constructed is simple in construction, can grip sheets with high accuracy, and operate at high speeds.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 8(*b*) is a side elevational view of a gripper pad assembly;

DESCRIPTION OF THE PREFERRED EMBODIMENT

Figure 1:
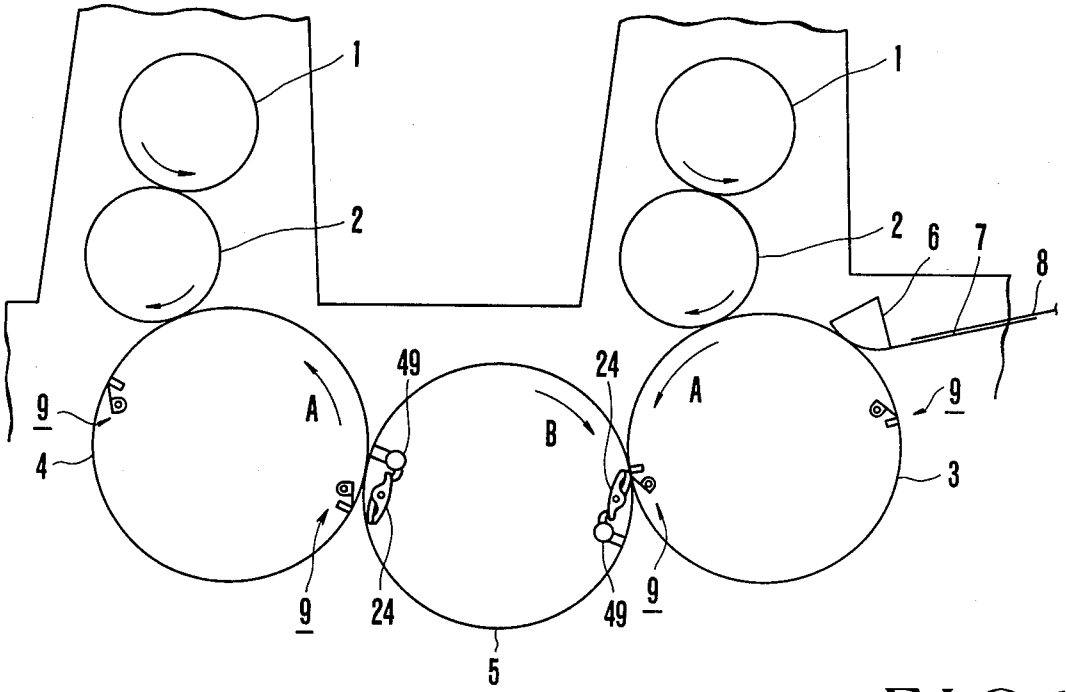
FIG. 1 is a schematic side elevational view of a sheet-fed rotary printing machine with a turn-over mechanism.
Figure 2:
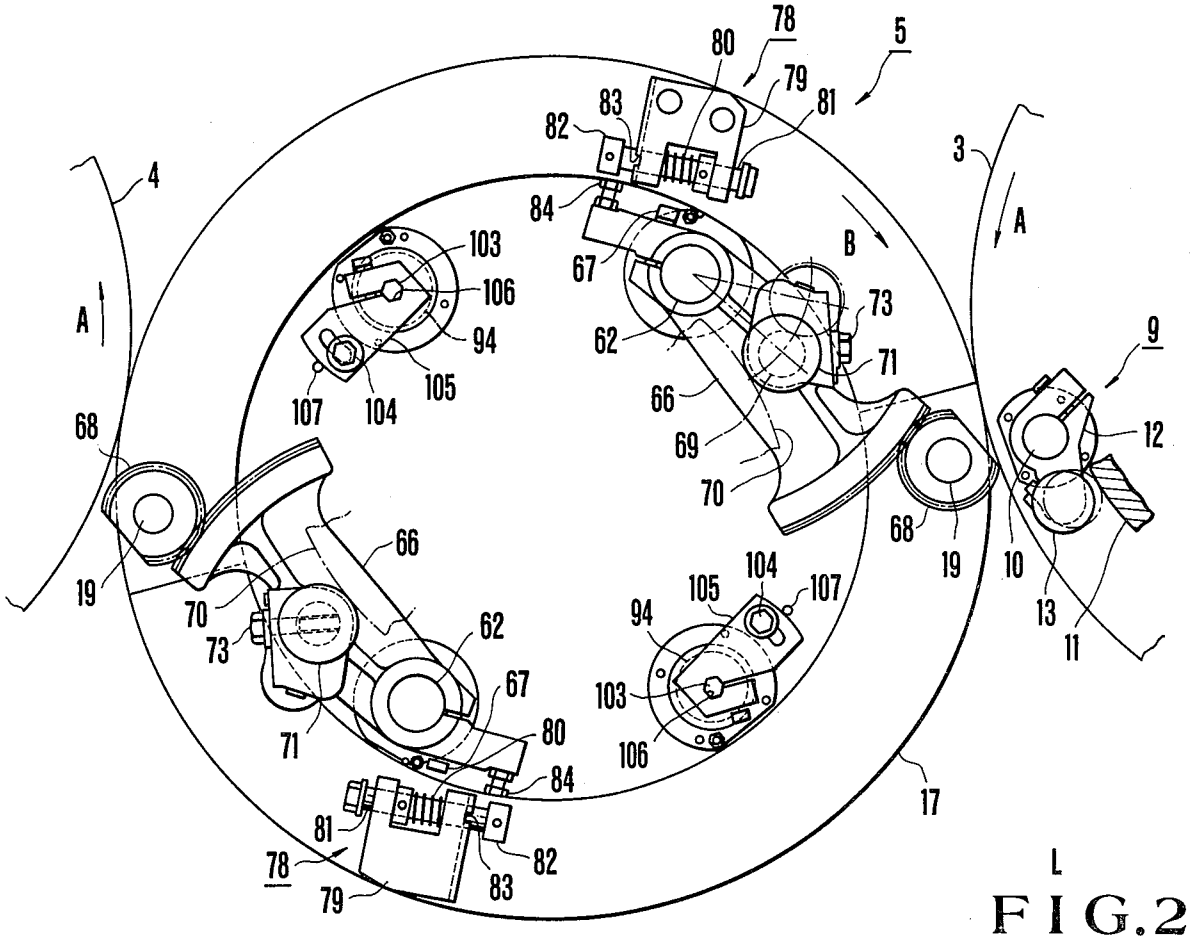
FIG. 2 is an enlarged side elevational view of a turn-over cylinder showing an operation side thereof.

As shown in FIG. 1, a sheet-fed rotary printing machine comprises a pair of first and second printing units each including a plate cylinder 1 with a printing plate mounted peripherally thereon, an inking apparatus and a dampening apparatus (not shown) for supplying ink and water to the surface of the printing plate, and a blanket cylinder 2 disposed below and held peripherally against the plate cylinder 1 for receiving an ink image from the plate cylinder 1, the blanket cylinder 2 being of the same diameter as that of the plate cylinder 1. A pair of first and second impression cylinders 3, 4 are positioned below and held peripherally against the blanket cylinders 2, 2, respectively, each impression cylinder has a diameter twice those of the blanket cylinders 2. A turn-over cylinder 5 of the same diameter as that of each impression cylinder is interposed between the impression cylinders 3, 4. The printing machine has a swing pre-gripper 6 swingable by a cam mechanism and having swing grippers swingably movable by a cam mechanism. The swing pre-gripper 6 serves to grip the leading edge of each of sheets 8 fed one by one onto a feedboard by a paper sheet feeder (not shown), and to supply the sheet 8 to the first impression cylinder 3. Each of the impression cylinders 3, 4 is rotatable in the direction of the arrow A, and has a pair of gripper shafts 10 (FIG. 2) pivotably movably supported in diametrically opposite relation. Each impression cylinder 3, 4 has a plurality of gripper devices 9 each composed of grippers actuable by cam mechanisms and gripper pads coacting with the grippers for gripping the sheet 8 supplied from the swing grippers of the swing pre-gripper 6 and from turn-over grippers 24 (described later) on the turn-over cylinder 5, and for winding the sheet peripherally around the impression cylinder as it rotates. The gripper devices 9 are mounted on each of the gripper shafts 10 at intervals therealong. As shown in FIG. 2, the gripper 9 can be opened and closed by a cam 11 fixed to a machine frame. A cam follower 13 is held against the cam surface of the cam 11 and mounted on a free end of a cam lever 12 having a slotted end fastened to an end of one of the gripper shafts 10.

Construction of the turn-over cylinder 5 will now be described. The turn-over cylinder 5 is journalled on a pair of lateral frames 14, 15 (FIGS. 5 and 6) by means of a taper roller bearing 16 for rotation about its own axis in the direction of the arrow B (FIG. 2). The turn-over cylinder 5 has a pair of paper gripper and turn-over devices mounted on its outer circumference in diametrically opposite relation. Since the paper gripper and turn-over devices are identical in construction, only one of the devices will be described. The turn-over cylinder 5 is composed integrally of a core, a circumferential sleeve, and a plurality of skeltons interconnecting the core and the circumferential sleeve. The turn-over cylinder 5 also has a pair of integral disk-shaped bearers 17, 18 at axial ends thereof as clearly shown in FIGS. 2 through 6. A gripper shaft 19 is journalled on the bearers 17, 18 at ends thereof by needle bearings 21, 21, the gripper shaft 19 being prevented from axial movement by a collar 20 secured thereto. The gripper shaft 19 is also journalled at intermediate locations by gripper bearings 23 fixed to the bottom of a recess 22 in the periphery of the cylinder 5.

Figure 4:
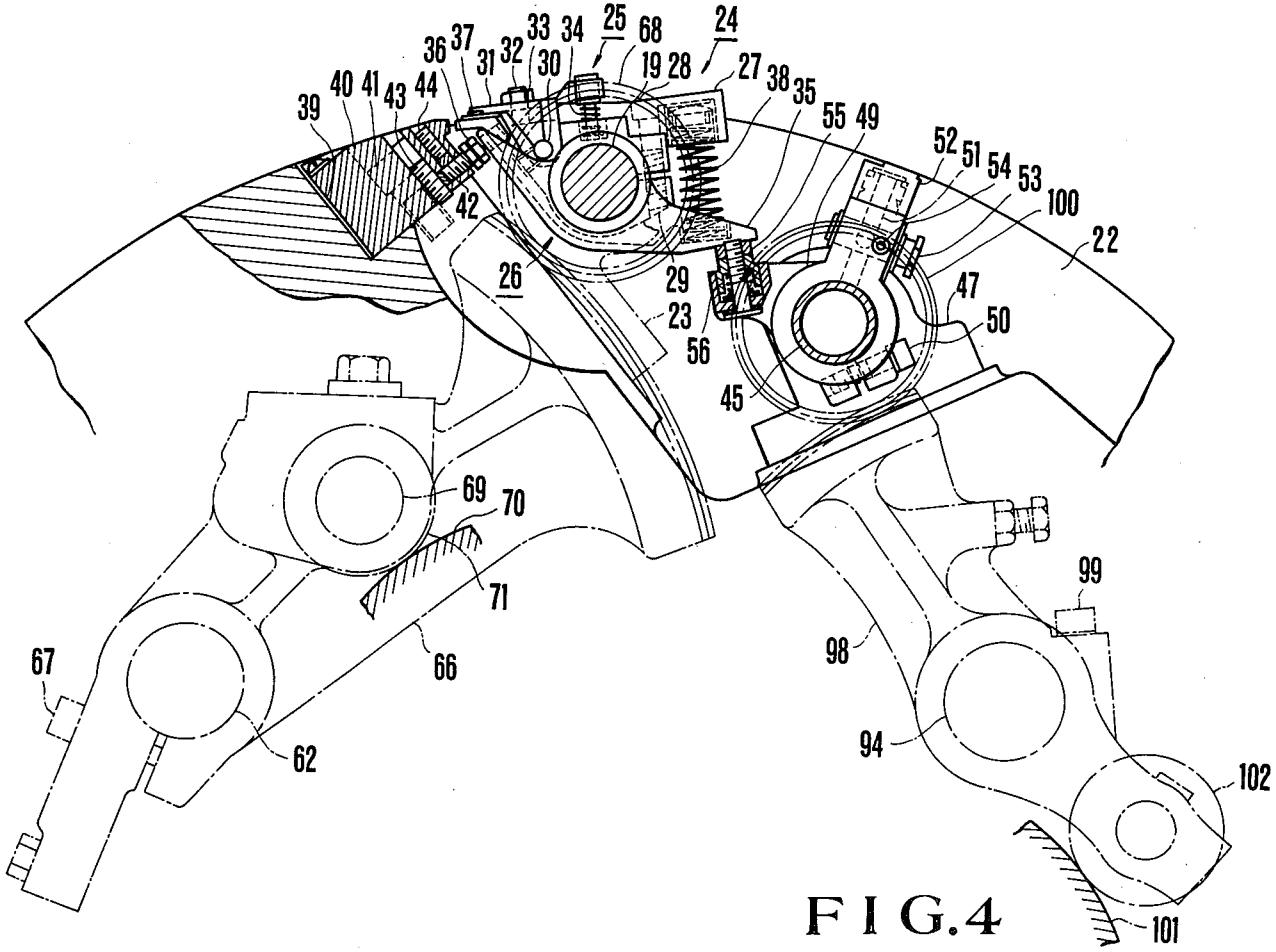
FIG. 4 is a fragmentary enlarged cross-sectional view of a periphery of the turn-over cylinder.
Figure 5:
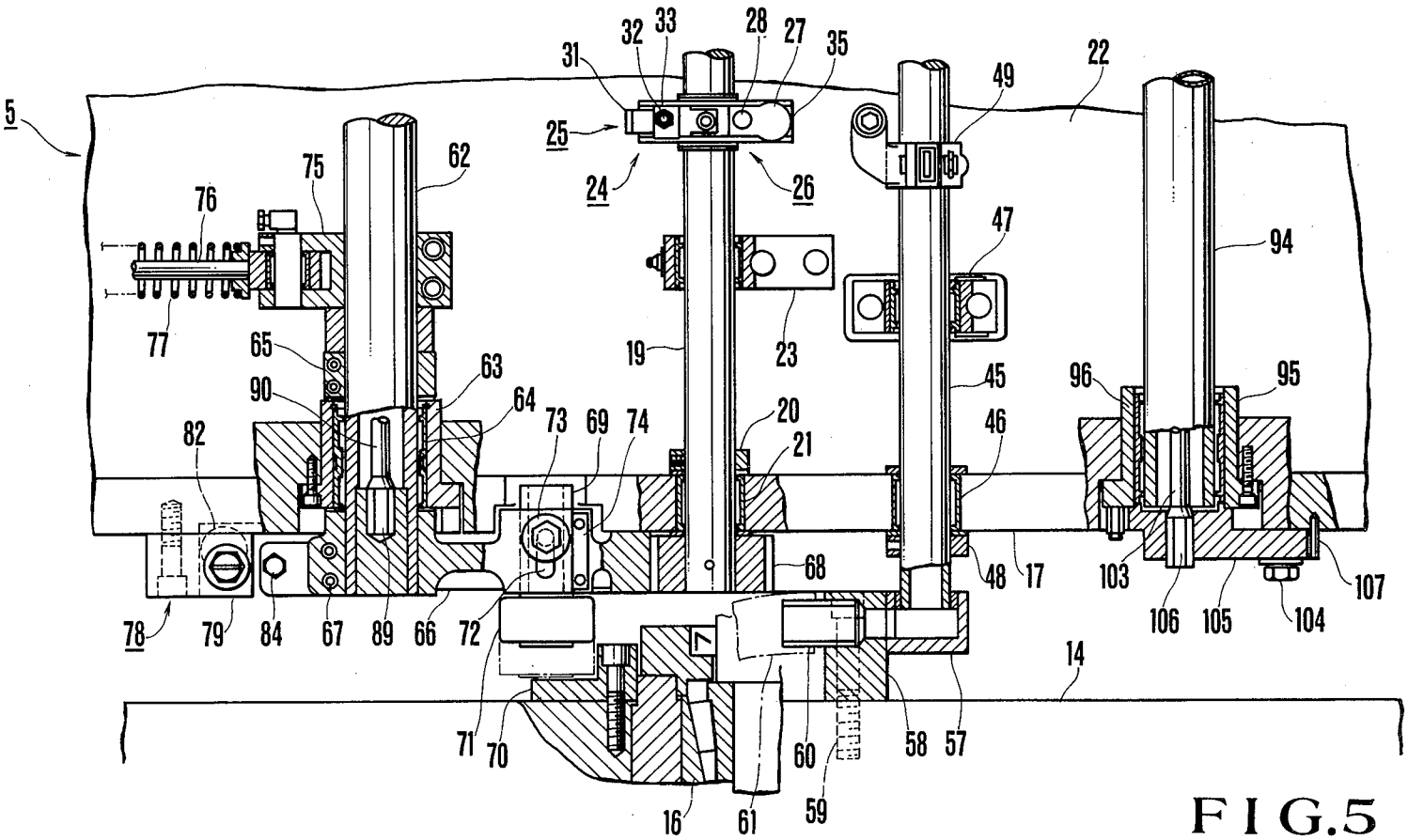
FIG. 5 is a fragmentary plan view, with parts in cross section, of an outer periphery of the operation side end of the turn-over cylinder as it is developed.
Figure 7:
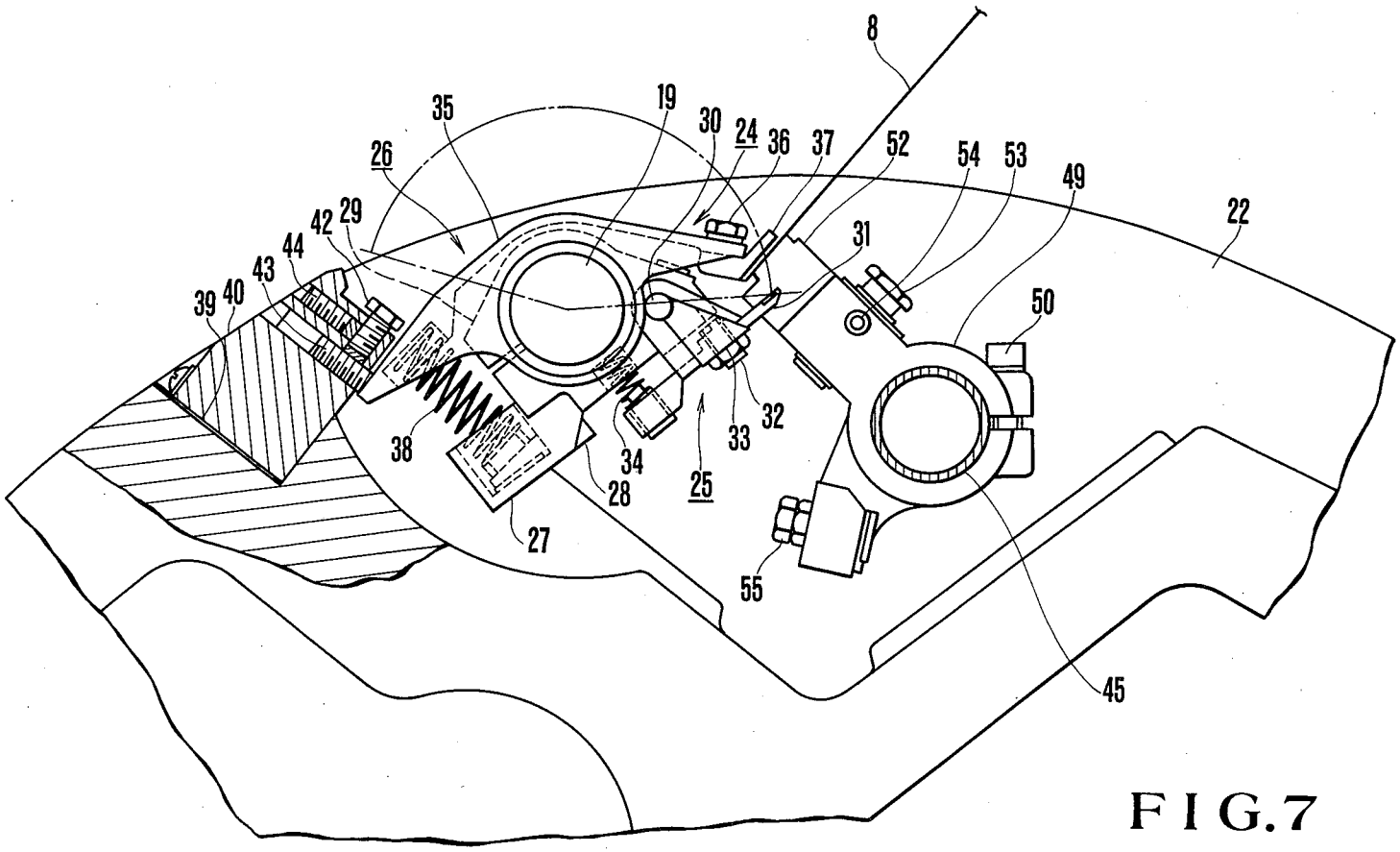
FIG. 7 is a fragmentary enlarged cross-sectional view of the periphery of the turn-over cylinder, illustrative of the manner in which a sheet edge is gripped for double side printing.
Figure 8A:
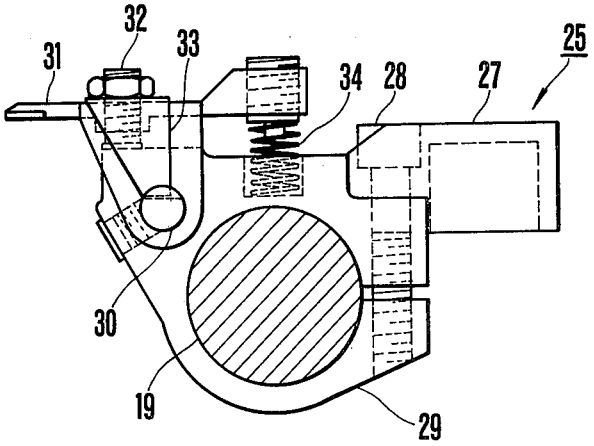
FIG. 8(*a*) is a side elevational view of a turn-over gripper.
Figure 8B:
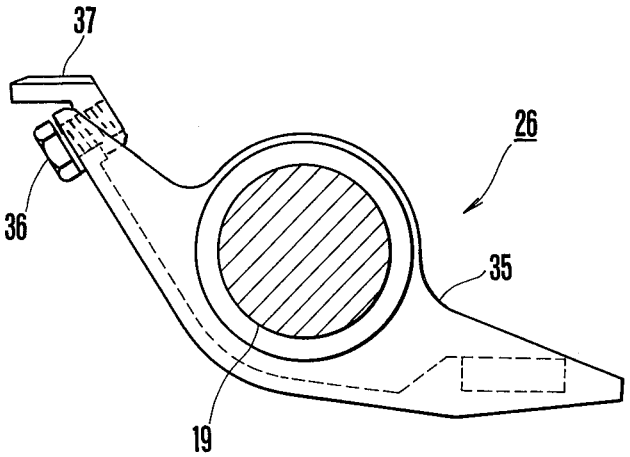

A plurality of turn-over gripper devices, generally designated at 24 in FIGS. 4 and 5, are mounted on the gripper shaft 19 in axially staggered relation to the grippers 9 on the impression cylinders 3, 4. Each turn-over gripper device 24 is composed of a turn-over gripper 25 (FIG. 8(*a*)) and a gripper pad assembly 26 (FIG. 8(*b*)). The turn-over gripper 25 comprises a gripper holder 29 having a slotted end fastened together with a spring seat 27 to the gripper shaft 19 by a bolt 28, and a gripper 31 pivotably mounted by a pivot shaft 30 on an eccentric portion of the gripper holder 29. An adjustment screw 32 is threaded into the gripper 31 with an L-shaped stop washer 33 interposed, the adjustment screw 32 having a head held against an upper surface of the gripper holder 29. A gripper spring 34 is disposed between the gripper 31 and the gripper holder 29 for normally urging the gripper 31 to turn counterclockwise as shown in FIG. 8(*a*). The gripper pad assembly 26 comprises a gripper pad holder 35 having a trough-shaped configuration accommodating therein the turn-over gripper 25 and a gripper pad 37 mounted by a bolt 36 on an end of the gripper pad holder 35 in confronting relation to the gripper 31. A gripper spring 38 (FIG. 4) is interposed between the other end of the gripper pad assembly and the spring seat 27 of the turn-over gripper 25 for normally urging the gripper 31 and the gripper pad 37 in a closing direction. The turn-over cylinder 5 also has in its outer peripheral surface a notch 39 adjacent to the gripper ends of the turn-over gripper devices 24. A stop mount 40 is fixedly mounted in the notch 39 by bolts 41, and extends the full axial length of the turn-over cylinder 5. A plurality of stops 42 are threaded in the stop mount 40 in alignment with the turn-over gripper devices 24 for limiting angular movement of the turn-over gripper devices 24 through abutting engagement with the bolts 36 on the gripper pad assemblies 26. The stops 42 are adjustable by screws 43, 44 in their looseness with respect to the stop mount 40. Also, the stops 43 are for stopping the gripper pad holders 35 reversely rotating and can be adjusted by the stops 42 in their looseness with respect to the stop mount 40. The turn-over gripper devices 24 are angularly movable in unison by a turn-over drive device (described later) through about 180° between the position shown in FIG. 4 and the position of FIG. 7.

A suction lever shaft 45 in the form of a hollow tube is disposed in the recess 22 in the turn-over cylinder 5 and rotatably journalled on the bearers 17, 18 by means of needle bearings 46. The suction lever shaft 45 is also jounalled at intermediate locations by bearings 47 mounted in the recess 22, the suction lever shaft 45 being limited by collars 48 against axial movement. A plurality of suction levers 49 are mounted on the suction lever shaft 45 at intervals corresponding to the turn-over gripper devices 24. Each of the suction levers 49 is L-shaped as seen in both side elevational and plan views, and has a slotted end fastened to the suction lever shaft 45 by a bolt 50. On one free end of the suction lever 49, there is mounted a suction head 52 having in an end surface a suction hole communicating with the interior of the suction lever shaft 45 through a communication hole 51. A valve pin 53 extends across the communication hole 51 for opening and closing the same and is secured in place by a bolt 54 of synthetic resin which allows the valve pin 53 to be resiliently braked against accidental displacement. The suction lever 52 has another free end on which there is slidably mounted a stop 55 composed of a spring seat, a bolt, and a nut for limiting angular movement of the gripper pad assembly 26, the stop 55 being normally urged by a compression spring 56 in a projecting direction. The hollow suction lever shaft 45 has one end closed off and other end projecting through the bearer 17 toward the frame 14 and angularly movably fitted in an annular rotary valve 57. The interior of the hollow suction lever shaft 45 is held in communication with an arcuate hollow portion in the rotary valve 57. A valve 58 is secured by a bolt 59 to the frame 14. The valve 58 is annular in shape so that the rotary valve 57 has an inner peripheral surface slidably held against the outer peripheral surface of the valve 58. The valve 58 has a suction port 60 which can communicate with the interior of the rotary valve 57 when the latter is brought into alignment with the suction port 60. A flexible tube 61 connected to a suction device mounted on a machine base is fitted in the suction port 60. Although not shown, an arcuate air tube of rubber is connected by a flexible tube to the suction device and disposed around an outer periphery of the turn-over cylinder 5 upstream of the suction levers 49 in the direction of rotation of the turn-over cylinder 5. The arcuate air tube serves to press the sheet 8 against the peripheal surface of the first impression cylinder 3 between prescribed timings prior to the sheet's being attracted by the suction levers 49.

A driving device for turning over and opening and closing the turn-over gripper devices 24 and angularly moving the suction levers 49 will be described. Upstream of the gripper shaft 19 in the direction of rotation of the turn-over cylinder 5, there is disposed a turn-over drive shaft 62 in the form of a hollow shaft rotatably journalled by bushings 63 and needle bearings 64 on thicker portions of the bearers 17, 18. The turn-over drive shaft 62 is prevented from axially moving by a collar 65 and a segment gear 66 (desdribed later). The segment gear 66 has a slotted end fastened by a bolt 67 to a projecting end of the turn-over drive shaft 62 beyond the bearer 17. The segment gear 66 has on its free end segment teeth held in mesh with a pinion 68 fixed to the projecting end of the gripper shaft 19. A pin 69 is slidably journalled in the central portion of the segment gear 66. A cam follower 71 is fitted over the pin 69 and held against a turn-over cam 70 affixed to the frame 14. The pin 69 is axially movable along an oblong hole 72 so that the cam follower 71 may move between the solid-line position and the dot-and-dash-line position as shown in FIG. 5. The cam follower 71 is thus selectively fixed by a bolt 73 in a position in which the cam follower 71 is held against the turn-over cam 70 and a position in which the cam follower 71 is held out of engagement with the cam 70. With this arrangement, rotation of the turn-over cylinder 5 causes the segment gear 66 to swing through the coaction between the cam surface of the turn-over cam 70 and the cam follower 71. Accordingly, the turn-over gripper devices 24 are turned over through about 180° as described above at prescribed timing. Designated in FIG. 5 at 74 is a scale plate indicative of the position of the cam follower 71.

A pair of spring levers 75 are fixedly mounted on the turn-over drive shaft 62 at inner position close to the bearers 17, 18. A spring shaft 76 has one end pivotably connected to a free end of each spring lever 75 and extends across the center of the cylinder toward a diametrically opposite peripheral surface of the cylinder where the end of the spring shaft is slidably supported by a bearing. A compression coil spring 77 is disposed around the spring shaft 74 for normally urging the segment gear 66 to turn in a direction to press the cam follower 71 against the cam surface of the turn-over cam 70. A stop 78 is affixed to a radially outward portion of the bearer 17 and has a pin 81 (FIG. 2) slidably supported on a support plate 79 and having a compression spring 80, and an oval cam 82 mounted on a distal end of the pin 81. By pushing the pin 81 against the force of the compression coil spring 80 while turning the pin 81 through 90° to change the position of engagement in a recess 83, a larger-diameter portion of the cam 82 pushes a bolt 84 on an end of the segment gear 66 to cause the cam follower 71 to be slightly disengaged from the cam surface of the turn-over cam 70, thus facilitating axial movement of the can follower 71.

The projecting end of the gripper shaft 19 beyond the bearer 18 supports a cam lever 85 fixed thereto with a cam follower 86 pivotably mounted on the cam lever 85. The cam follower 86 is capable of engaging either one of a gripper cam 87A, a release cam 87B, and a turn-over gripper cam 88 fixed to the frame 15 in circumferentially staggered relation. More specifically, when the turn-over gripper device 24 is in the position of FIG. 4 in which it is not turned over, the gripper cam 87A serves to open and close the turn-over gripper 25 for gripping the sheet 8 fed from the first impression cylinder 3. When the turn-over gripper device 24 is turned to the FIG. 7 position, the turn-over gripper cam 88 serves to open and close the turn-over gripper 25 to grip the sheet 8 from the first impression cylinder 3. The release cam 87B serves to open and close the turn-over gripper 25 to release the sheet 8 off toward the second impression cylinder 4.

A torsion bar 90 extends axially through the turn-over drive shaft 62 and has a hexagonal end head fitted in a hexagonal hole 89 defined in the end of the turn-over drive shaft 62. The torsion bar 90 also has an opposite hexagonal end head fitted in a hexagonal hole 93 defined in a bearing plate 92 angularly adjustably secured by a bolt 91 to the bearer 18. Designated at **92*a* is a marker pin for indicating the angular position of the bearing plate 92. The torsion bar 90 is torsionally adjusted by the bearing 92 so that it will store the resilient energy even when the cam followers 71, 86 are disengaged from the cams 70, 87A, 87B, 88 to release the gripper shaft 19 from angular movement. The torsion bar 90 thus biases the turn-over grippers 25 in a closing direction through the segment gear 66 and the pinion 68**.

A suction drive shaft 94 in the form of a hollow shaft is disposed upstream of the suction lever shaft 45 in the direction of rotation of the turn-over cylinder 5. The suction drive shaft 94 is rotatably journalled on thicker portions of the bearers 17, 18 by bushing 95 and needle bearings 96. The suction drive shaft 94 is limited by a collar 97 and a segment gear 98 against axial movement. The segment gear 98 has a slotted end fastened by bolts 99 to an end of the suction drive shaft 94 which projects through the bearer 18. The segment gear 98 has on a free end thereof segment teeth held in mesh with a pinion 100 fixed to the projecting end of the suction lever shaft 45. The segment gear 98 has an opposite free end over which there is fitted a cam follower 102 held against a suction lever turning cam 101 secured to the frame 15. When the turn-over cylinder 5 rotates, the segment gear 98 is turned through the coaction of the suction lever turning cam 101 and the cam follower 102 for thereby turning the suction lever 49 from the position of FIG. 4 to the position of FIG. 7 at prescribed timing. A torsion bar 103 axially extends through the suction drive shaft 94 and has a hexagonal end head fitted in a hexagonal hole defined in an end of the suction drive shaft 94. The torsion bar 103 also has on an opposite end a hexagonal head fitted in a hexagonal hole 106 defined in a bearing plate 105 angularly adjustably mounted by a bolt 104 on the other bearer 17. Designated at 107 is a marker pin for indicating the angular position of the bearing plate 105. The torsion bar 103 urges the segment gear 98 to turn the cam follower 102 in a direction to be pressed against the cam surface of the suction lever turning cam 101. A stop 108 is mounted on a radially outward portion of the bearer 18 for preventing the segment gear 98 from turning counterclockwise in FIG. 3 in the position in which the cam follower 102 engages a higher portion of the suction lever turning cam 101. The stop 108 is identical in construction to the stop 78 and will not be described in detail, the identical parts being denoted by identical reference numerals. However, the cam 82 has a much higher lift than that on the stop 78 for moving the cam follower 102 for a greater interval.

Figure 9:
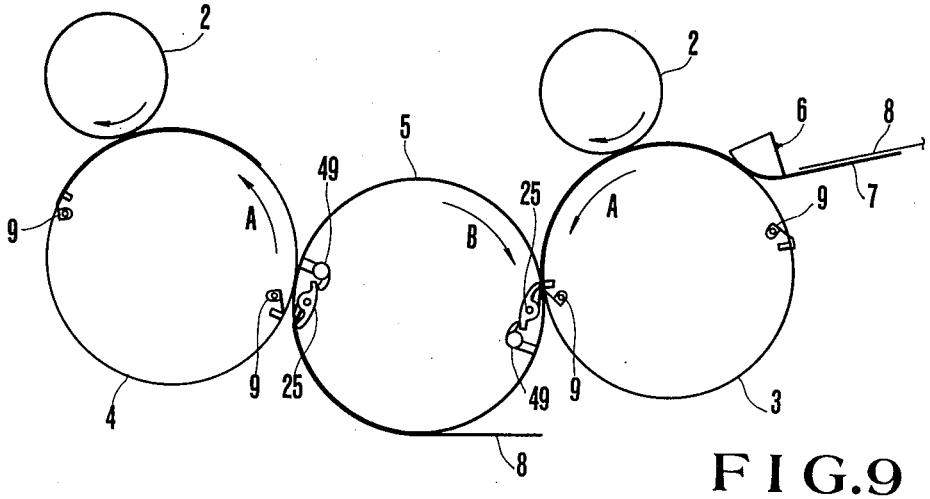
FIG. 9 is a schematic side elevational view of the printing machine, showing single side printing operation.

Single side printing operation of the sheet-fed rotary printing machine with the turn-over mechanism will be described with reference to FIG. 9. When the printing mode is to be switched from double side printing to single side printing, the cam 82 of the stop 108 is turned as shown by the dot-and-dash line in FIG. 3 in the position in which the cam follower 102 engages the higher portion of the suction lever turning cam 101, thereby preventing the segment gear 98 from rotating from this position. Then, the cam 82 of the stop 78 is turned to push the bolt 84 of the segment gear 66 for spacing the cam follower 71 slightly from the turn-over cam 70 to release the spring-biased pressing force. Thereafter, the cam follower 71 and the pin 69 are axially moved to disengage from the turn-over cam 70 for returning the stop 78 to the original position. As shown in FIG. 4, this applies the resilient force from the torsion bar 90 in the turn-over drive shaft 62 to the gripper shaft 19 through the segment gear 66 and the pinion 68, so that the gripper shaft 19 is urged to turn counterclockwise as shown. Since the gripper pad holder 35 is prevented from angular movement by the stop 42 on the stopper mount 40 and the stop 56 on the suction lever 49, the gripper 31 is pressed into the closing position against the gripper pad 37 under the turning force from the gripper shaft 19 and the resilient force from the gripper spring 38. In this position, the gripper shaft 19 is not turned, that is, the gripper 31 is not opened and closed by the segment gear 66, but is actuated only by the gripper cam 87A and the release cam 87B. The printing machine thus operates in the same manner as that of ordinary printing machines designed for single side printing, except that the gripper pads are differently shaped. Since the suction lever 49 remains inoperative, the suction device and other accessories coupled therewith are de-activated.

After the parts have thus been readied, printing operation is started. A sheet 8 fed onto the feedboard 7 is delivered by the swing pre-gripper 6 and gripped by the grippers 9 on the impression cylinder 3 so as to be wound therearound. While the sheet 8 passes between the impression cylinder 3 and the blanket cylinder 2, the sheet 8 is printed on a surface facing the blanket cylinder 2. When the cylinders further rotate until the gripper 9 on the impression cylinder 3 faces the turn-over gripper device 24 on the turn-over cylinder 5, the cam follower 86 engages the larger-diameter portion of the gripper cam 87A, causing the cam lever 85 to swing against the resiliency of the torsion bar 90 for thereby opening the gripper 81. As the cam followr 86 moves past the larger-diameter portion of the gripper cam 87A, the gripper 31 is closed under the resilient force of the torsion bar 90. Simultaneously with the opening and closing movement of the gripper 31, the gripper 9 on the impression cylinder 3 is also opened and closed, so that the sheet 8 is released from the gripper 9 and gripped by the gripper 31. The sheet 8 is then wound peripheraly around the turn-over cylinder 5 as the latter further rotates. When the turn-over gripper device 24 faces the gripper 9 on the second impression cylinder 4, the cam follower 86 moves past the largest-diameter portion of the release cam 87B to open and close the gripper 31. Since the gripper 9 is opened and closed at the same time, the sheet 8 is released from the turn-over cylinder 5 and wound peripheraly around the second impression cylinder 4. As the sheet 8 travels between the blanket cylinder 2 and the second impression cylinder 4, it is printed on the same side as that on which printing has been effected in the first printing unit, thereby completing a cycle of single side printing.

Figure 3:
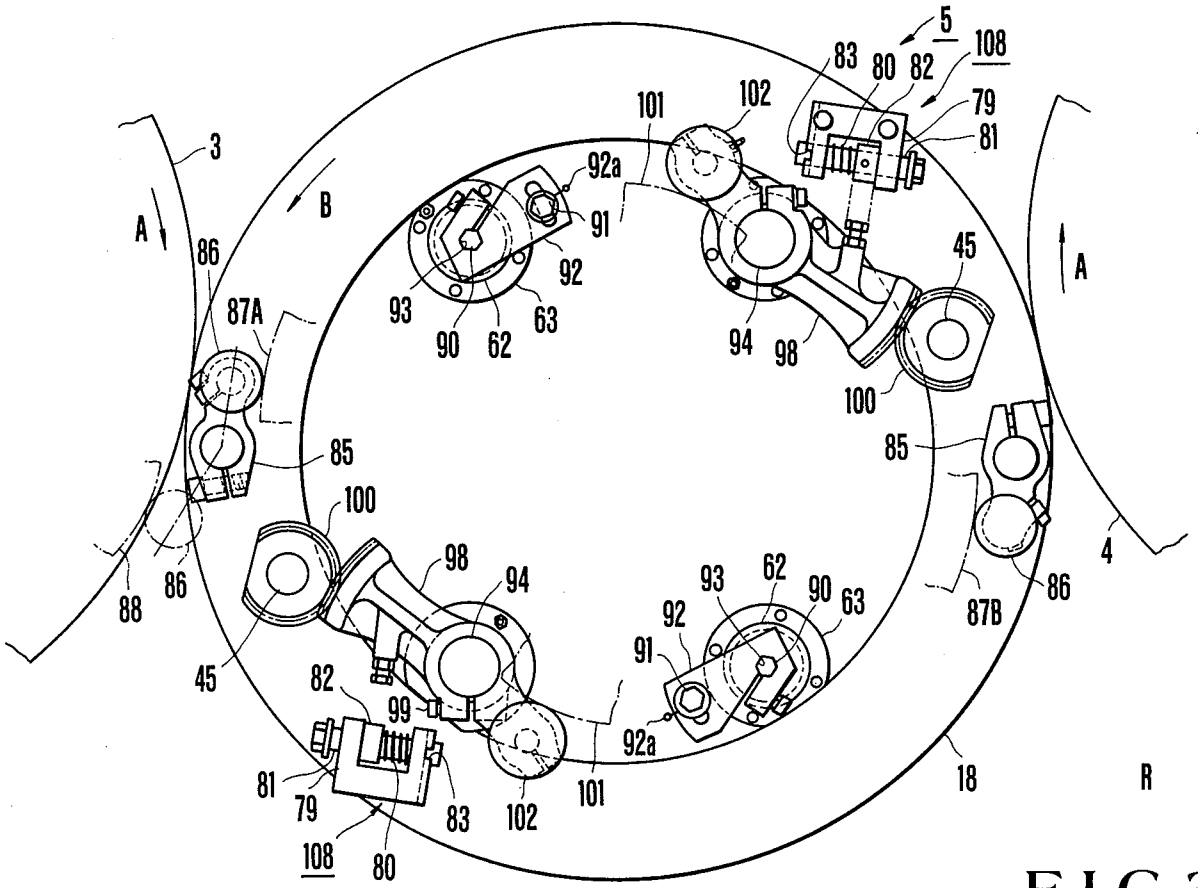
FIG. 3 is an enlarged side elevational view of the turn-over cylinder showing a drive side thereof.
Figure 6:
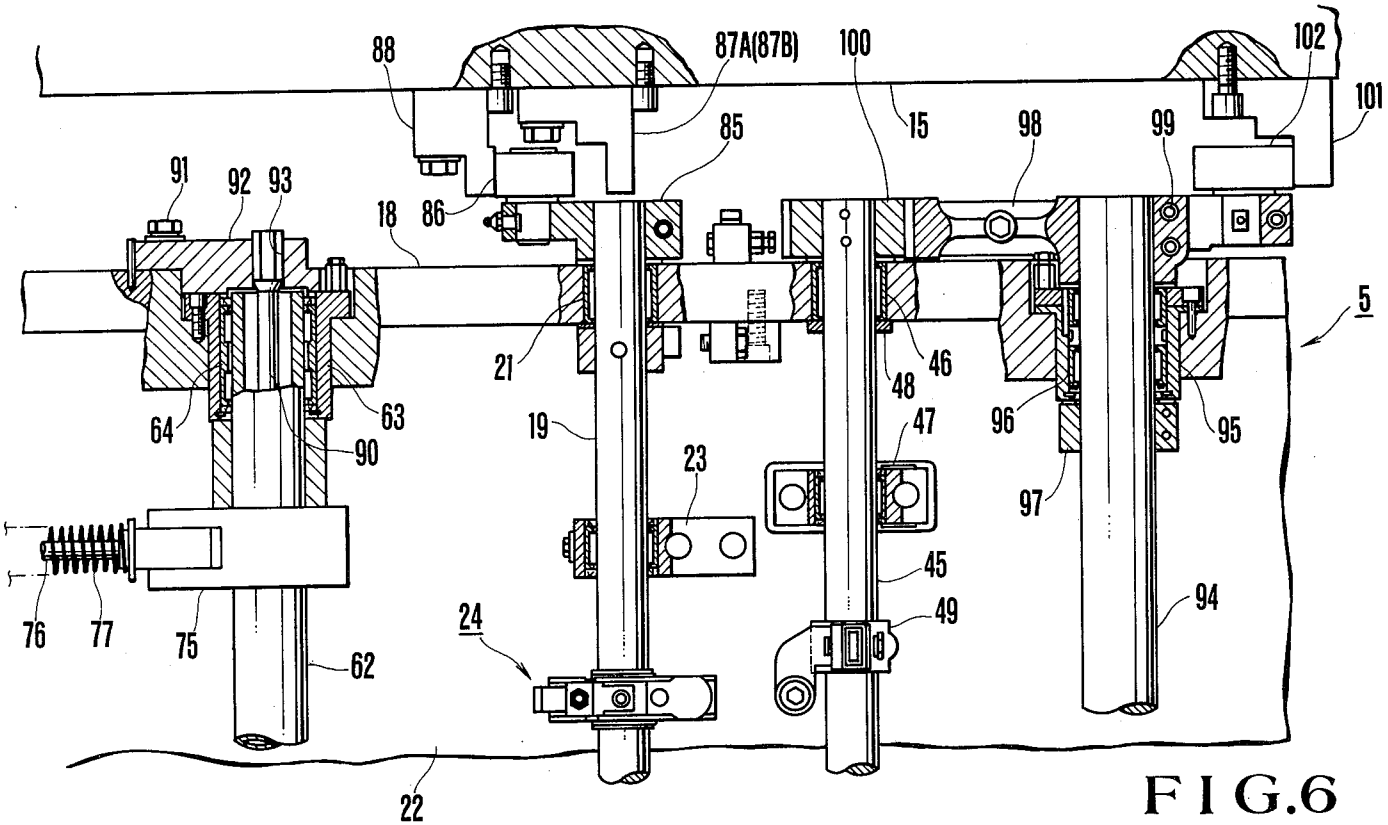
FIG. 6 is a fragmentary plan view, partly in cross section, of an outer periphery of the drive side end of the turn-over cylinder as it is developed.
Figure 10A:
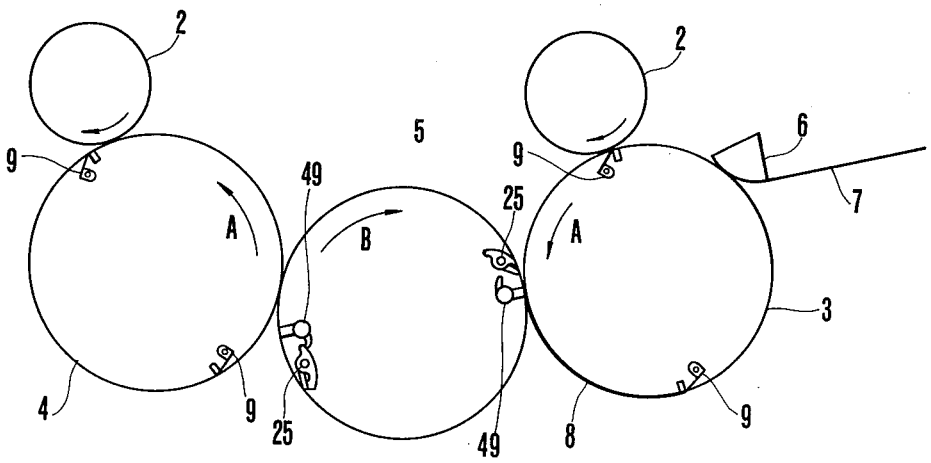
FIGS. 10(*a*) through 10(*c*) are schematic side elevational views of the printing machine, illustrating progressive steps of double side printing operation.
Figure 10B:
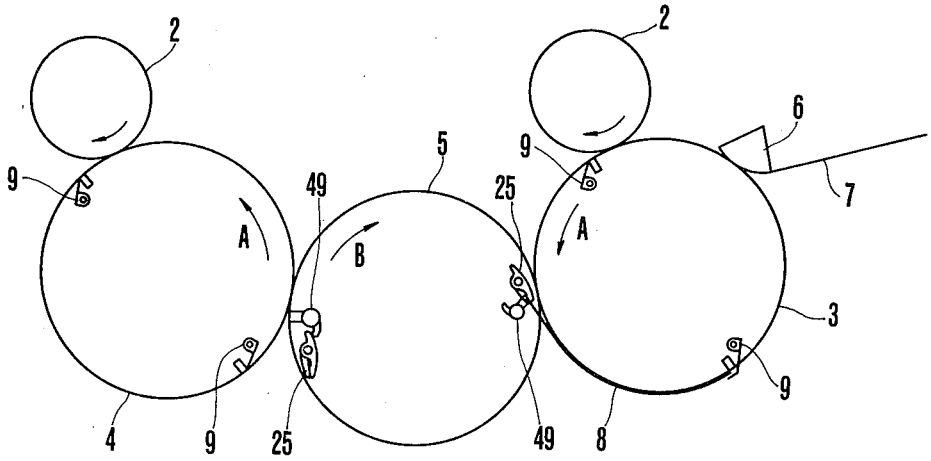
Figure 10C:
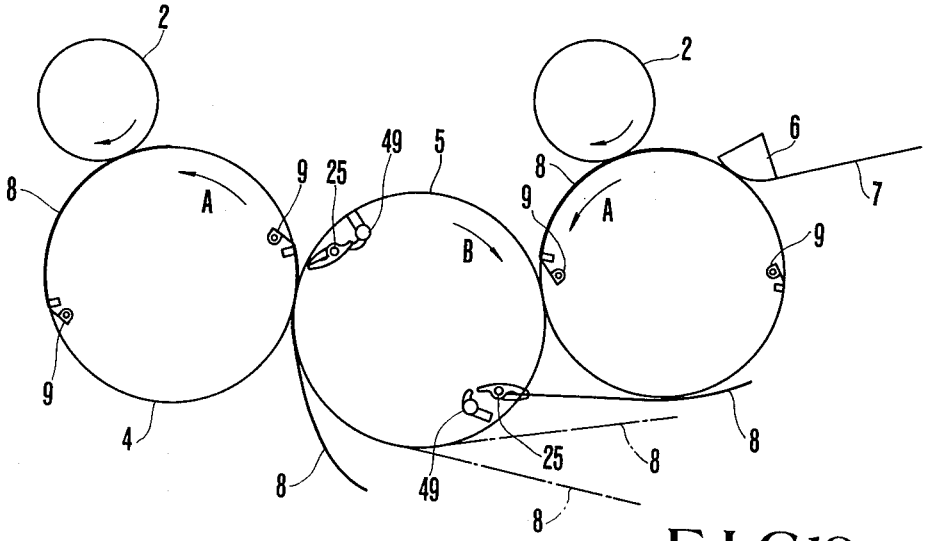

Double side printing operation will be described with reference to FIGS. 1 through 8 and FIGS. 10(*a*) through 10(*c*). When the printing mode is to be switched from single side printing operation to double side printing operation, it necessary to change the relative position of the turn-over gripper 25 on the turn-over cylinder 5 and the gripper 9 on the first impression cylinder 3 so that the turn-over gripper 25 will grip the trailing edge of the sheet 8, rather than the leading edge thereof as for single side printing. To effect this, the downstream cylinders including the turn-over cylinder 5 and the upstream cylinders including the first impression cylinder 3 are shifted in phase substantially for a sheet size by an adjustment device (not shown). The sheet releasing timing of the cam for opening and closing the gripper 9 on the first impression cylinder 3 is delayed for an interval corresponding substantially to a sheet size. The cam follower 71 for the turn-over cam 70 is axially moved into engagement with the turn-over cam 70, and the segment gear 98 is released from the stop 108. The gripper shaft 19 is now allowed to turn by both the turn-over cam 70 and the gripper cam 87A, release cam 87B and turn-over gripper cam 88, and the suction lever 49 is rendered ready for angular movement. When single side printing is started after the parts have thus been adjusted, a sheet 8 is gripped by the gripper 9 on the impression cylinder 3 and printed on its side facing the blanket cylinder 2 while travelling between the latter and the first impression cylinder 3. After the sheet 8 has been released from the cylinders 2, 3 the air tube (not shown) around the turn-over cylinder 5 ejects air to press the sheet 8 against the peripheral surface of the impression cylinder 3 as the sheet 8 is wound around the impression cylinder 3 until the trailing edge thereof faces the turn-over cylinder 5. Slightly prior to this, the cam follwer 102 of the segment gear 98 reaches the larger-diameter portion of the suction lever turning cam 101, whereupon the segment gear 98 is turned against the resiliency of the torsion bar 103 to the position shown in FIG. 7 to allow the suction lever 49 to disengage from the gripper pad holder 35 through the pinion 100. Slightly thereafter, the cam follower 71 of the segment gear 66 reaches the larger-diameter portion of the turn-over cam 70 and is turned to cause the gripper shaft 19 to angularly move for a large angular interval through the pinion 68. The turn-over gripper device 24 is then caused to swing through a large annular interval to the position of FIG. 7. At this time, the turn-over gripper 25 remains closed. The suction lever 49 returns to the FIG. 4 position again after it has avoided the gripper pad holder 35 and no longer interferes with the latter. After all of the above actions have been carried out in a moment, the turn-over gripper device 24 and the suction lever 49 are positioned in confronting relation to the trailing edge of the sheet 8, whereupon the hollow portion of the rotary valve 57 faces the suction port 60 of the valve 58 to draw air, thus attracting the trailing edge of the sheet 8 to the suction lever 49. Substantially at the same time, the gripper 9 on the first impression cylinder 3 is opened to release the sheet 8. As the cylinders slightly rotate thereafter, the suction lever 49 with the sheet 8 attracted thereto is turned to the position of FIG. 7. The parts of the printing machine now assume the position shown in FIG. 10(*b*). At this time, the cam lever 85 mounted on the other shaft end is caused by the turning movement of the gripper shaft 19 to turn for a large angular interval until the cam follower 86 faces the turn-over gripper cam 88 as shown in FIGS. 3 and 6. The gripper shaft 19 turns reciprocably in response to the movement of the cam follower 86 past the larger-diameter portion of the turn-over gripper cam 88, resulting in the turn-over gripper 25 being closed. More specifically, the trailing edge of the sheet 8 is gripped by the turn-over gripper 25 by first opening the turn-over gripper 25, turning the suction lever 49 to supply the trailing edge to the turn-over gripper 25 as thus opened, and then closing the turn-over gripper 25. At the same time, suction air to the suction lever 49 is shut off. As the cylinders further rotate, the turn-over gripper 25 with the trailing edge of the sheet 8 gripped thereby revolves with the turn-over cylinder 5 to feed the sheet 8 as shown in FIG. 10(*c*). Simultaneously, the cam follower 71 is shifted to the smaller-diameter portion of the turn-over cam 70, and the turn-over gripper device 24 bodily returns to the position of FIG. 4 under the resiliency of the compression coil spring 77 and the torsion bar 90, in which position the turn-over gripper device 24 is held against the second impression cylinder 4. The suction lever 49 is also returned to the position of FIG. 4 under the resilient force of the torsion bar 103. As a result of such sheet transfer, the sheet 8 is turned over and wound around the turn-over cylinder 5 with the printed side facing the periphery of the turn-over cylinder 5. After the turn-over gripper device 24 and the suction lever 49 have angularly moved, the printing machine operates in the same manner as that in single side printing operation. The turn-over gripper 25 is opened and closed by the release cam 78B, and the gripper 9 on the second impression cyliner 4 is opened and closed to grip the sheet 8, which is then wound on the impression cylinder 4. When the sheet 8 passes between the blanket cylinder 2 and the impression cylinder 4, the sheet 8 is printed on the reverse side thereof, thereby completing one cycle of double side printing operation.

During the single side printing mode, the gripper pad 37 together with the gripper pad holder 35 is fixed in position by the stops 42, 55, and operates in the same manner as that of ordinary gripper devices having a fixed gripper pad and a gripper. More specifically, the gripper 31 is urged by the gripper spring 34 in a direction to grip a sheet, and is opened by the gripper cam 87A and the release cam 87B, and closed under the resilient force of the torsion bar 90 and the gripper spring 38. When the printing mode is shifted from single side printing to double side printing, the gripper shaft 19 about which the turn-over gripper 35 turns remains the same as in the single side printing operation. The gripper pad 37 which has been fixed during the single side printing mode is now released, together with the gripper pad holder 35, from engagement with the stop 55. The gripper pad 37 can now be turned over and returned by the turn-over cam 70 and the torsion bar 90 and the compression coil spring 77. The turn-over gripper 25 is opend by the turn-over gripper cam 88 and the release cam 87B, and closed under the resilient force of the torsion bar 90 and the gripper spring 78.

In the foregoing embodiment, the four cams, that is, the gripper cam 87A, the release cam 87B, the turn-over cam 88, and the turn-over cam 70 are separately provided for opening, closing and turning over the turn-over gripper 25, and the cam lever 85 and the segment gear 66 are provided as cam levers for these cams. However, a single single side printing cam equivalent to the gripper cam 87A and the release cam 87B disposed on one circumferential surface, and a single double side printing cam equivalent to the turn-over cam 70 and the turn-over gripper cam 88 disposed on one circumferential surface may be provided with the segment gear 66 shared by these cams. With this alternative, the two circumferential single and double side printing cams are juxtaposed adjacent to each other, and have the same basic circles as lower cam portions with a cam lift of the double side printing cam being larger than that of the single side printing. For single side printing, the cam follower is held against the single side printing cam only for opening and closing the gripper. For double side printing, the cam follower is held against both the single and double side printing cams. In the double side printing mode, the cam follower moves past the cam surface corresponding to the turn-over cam to turn over the turn-over cam, then the cam follower moves past a higher equal-diameter circular portion of the cam, and then moves past the cam surface corresponding to the turn-over gripper cam as the cam lift increases, for thereby opening and closing the gripper for gripping the sheet. To open and close the gripper for releasing the sheet, the sheet release surface of the single side printing cam is employed. With this arrangement, the number of cams needed is reduced, and the cam lever 85 and the segment gear 66 can be shared by a single segment gear, resulting in a simpler construction.

With a sheet-fed rotary printing machine with a turn-over mechanism of the present invention, as described above, both single and double side printing operations can be effected on the printing machine with a single turn-over mechanism interposed between two printing cylinders. During the single and double side printing modes, the turn-over gripper can be turned over and opened and closed on the same gripper shaft. The construction of the printing machine is highly simplified, the cost of installation is reduced, and the space taken up by the printing machine is also reduced. Thus, the printing machine is rendered smaller in size. Since the turn-over gripper is turned over around the gripper shaft, its moment of inertia can be reduced, with the results that sheets can be gripped with precision and the printing machine can operate at high speeds.

Although a certain preferred embodiment has been shown and described, it should be understood that many changes and modifications may be made therein without departing from the scope of the appended claims.

What is claimed is:

1. A sheet-fed rotary printing machine with a turn-over mechanism, comprising a pair of adjacent printing units having a pair of blanket cylinders, respectively, a pair of printing cylinders each having a diameter twice that of the blanket cylinders and gripper devices mounted on an outer periphery thereof in diametrically opposite relation, and a turn-over cylinder interposed between and held peripherally against said printing cylinders, said turn-over cylinder having a diameter twice that of the blanket cylinders, said turn-over cylinder having a pair of gripper shafts and a pair of suction lever shafts mounted on an outer periphery thereof in diameterically opposite relation and extending parallel to an axis of the turn-over cylinder, a plurality of turn-over grippers fixed to each of said gripper shafts at intervals, a plurality of gripper pad assemblies loosely fitted on each of said gripper shafts adjacent to said turn-over grippers, respectively, and having sheet gripping surfaces facing ends of said turn-over grippers, a gripper spring interposed between said turn-over gripper and said gripper pad assembly for resiliently urging them in a direction to grip a sheet therebetween, a turn-over cam mechanism for reciprocably turning said gripper shaft for turning over and turn-over gripper and said gripper pad assembly in unison between a sheet-leading-edge gripping position and a sheet-trailing-edge position, a gripper cam mechanism and a turn-over gripping cam mechanism for reciprocably turning said gripper shaft for opening and closing said turn-over gripper and said gripper pad assembly in both said positions, a sheet releasing mechanism for reciprocably turning said gripper shaft for opening and closing said turn-over gripper and said gripper pad assembly in a sheet releasing position, a plurality of suction levers mounted at intervals on each of said suction lever shafts in alignment with said turn-over grippers and axially staggered relation to the latter, and a suction lever turning cam mechanism for reciprocably turning said suction lever shaft for turning said suction lever between a position in which said gripper pad assembly is limited against angular movement and a position in which a sheet trailing edge is attracted.

2. A sheet-fed rotary printing machine according to claim 1, including a single side printing cam composed of a cam of a gripper cam mechanism and a cam of a release cam mechanism in one circumferential surface, and a double side printing cam composed of a cam of said turn-over gripper cam mechanism and a cam of said turn-over gripper cam mechanism in one circumferential surface, and a cam follower pivotably mounted on a cam lever shared by said single and double side printing cams, said cam follower being movable between a position in which said cam follower is held against both said single and double side printing cams and a position in which said cam follower is held against said single side printing cam.

* * * * *

UNITED STATES PATENT AND TRADEMARK OFFICE

CERTIFICATE OF CORRECTION

PATENT NO. : 4,448,125

DATED : May 15, 1984

INVENTOR(S) : Shoichi Kawaguchi and Hiroyuki Sugiyama

It is certified that error appears in the above—identified patent and that said Letters Patent is hereby corrected as shown below:

Column 5, line 51: Change "(desdribed" to --(described--

Column 6, line 29: Change "can" to --cam--

Claim 1, col. 12, line 5: Change "turning over and" to --turning over said--

Signed and Sealed this

*Nineteenth* Day of *March 1985*

[SEAL]

*Attest:*

DONALD J. QUIGG

*Attesting Officer*

*Acting Commissioner of Patents and Trademarks*